US006591793B2

(12) United States Patent
Nemoto et al.

(10) Patent No.: US 6,591,793 B2
(45) Date of Patent: Jul. 15, 2003

(54) TWO-CYCLE ENGINE

(75) Inventors: Toshihisa Nemoto, Tougane (JP); Terutaka Yasuda, Tougane (JP)

(73) Assignee: Maruyama Mfg. Co., Inc., Tokyo (JP)

( * ) Notice: Subject to any disclaimer, the term of this patent is extended or adjusted under 35 U.S.C. 154(b) by 0 days.

(21) Appl. No.: 09/813,510

(22) Filed: Mar. 20, 2001

(65) Prior Publication Data

US 2001/0011532 A1 Aug. 9, 2001

Related U.S. Application Data

(63) Continuation-in-part of application No. 09/697,011, filed on Oct. 25, 2000, and a continuation-in-part of application No. 09/697,012, filed on Oct. 25, 2000.

(30) Foreign Application Priority Data

Nov. 12, 1999 (JP) ..... 11-322993
Nov. 19, 1999 (JP) ..... 11-329833

(51) Int. Cl.[7] ..... F02B 43/00; F02B 33/00; F02B 25/18

(52) U.S. Cl. ..... 123/73 PP; 123/73 A; 123/73 C

(58) Field of Search ..... 123/73 PP, 738, 123/658, 748, 73 A, 73 B, 74 AP, 73 C

(56) References Cited

U.S. PATENT DOCUMENTS 3,980,064 A * 9/1976 Ariga et al. ..... 123/457
4,253,433 A * 3/1981 Blair ..... 123/73 R
4,286,553 A * 9/1981 Baltz et al. ..... 123/179.11
4,481,911 A * 11/1984 Sheaffer et al. ..... 123/73 R
4,638,770 A * 1/1987 Fox ..... 123/65 P
4,779,581 A * 10/1988 Maier ..... 123/73 A
4,829,940 A * 5/1989 Okazaki et al. ..... 123/41.39
5,027,758 A * 7/1991 Siegler ..... 123/73 AD
5,503,119 A * 4/1996 Glover ..... 123/73 B
5,628,295 A * 5/1997 Todero et al. ..... 123/568.13
5,685,273 A * 11/1997 Johnson et al. ..... 123/446
5,924,400 A * 7/1999 Kobayashi ..... 123/196 R
5,992,358 A * 11/1999 Otome ..... 123/65 P
6,223,705 B1 * 5/2001 Sato et al. ..... 123/73 PP
6,289,856 B1 * 9/2001 Noguchi ..... 123/73 PP
6,367,431 B1 * 4/2002 Nemoto et al. ..... 123/65 P
6,367,432 B1 * 4/2002 Araki ..... 123/73 R
6,415,750 B2 * 7/2002 Rosskamp et al. ..... 123/73 PP
6,418,891 B2 * 7/2002 Kobayashi ..... 123/73 PP

FOREIGN PATENT DOCUMENTS

JP 59185820 A * 10/1984 ..... F02B/17/00

* cited by examiner

*Primary Examiner*—Henry C. Yuen
*Assistant Examiner*—Hai Huynh
(74) *Attorney, Agent, or Firm*—Perkins Coie LLP

(57) ABSTRACT

Apparatuses and methods for controlling HC in exhaust, with Schnuerle type 2-cycle engine. When piston reaches near dead center point, the ends of the channel at the bottom end of piston reach from outlet ports and No. 1 transfer ports, and exhaust gas from outlet ports moves to the top of No. 1 transfer ports, and there a specified amount is kept. With scavenging, the pair of No. 1 transfer ports open first to combustion chamber, and the exhaust gas is introduced to combustion chamber, after which the pair of No. 2 transfer ports is opened to combustion chamber, and the air-fuel mixture is introduced to combustion chamber. Exhaust gas first introduced from No. 1 transfer ports creates a reverse eddy, and there is scavenging within combustion chamber, purging gas as it is into exhaust port. Air-fuel mixture introduced later from No. 2 transfer ports is limited in purging, and is kept in combustion chamber.

23 Claims, 4 Drawing Sheets

TWO-CYCLE ENGINE

RELATED APPLICATIONS

This application is a continuation-in-part application of, and claims priority from, copending U.S. patent application Ser. No. 09/697,011, filed on Oct. 25, 2000, which claims priority from, the Japanese Patent Application No. H11-322993, filed on Nov. 12, 1999, both of which are incorporated herein by reference.

This application is also a continuation-in-part application of, and claims priority from, copending U.S. patent application Ser. No. 09/697,012, filed on Oct. 25, 2000, which claims priority from the Japanese Patent Application No. H11-329833, filed on Nov. 19, 1999, both of which are incorporated herein by reference.

This application is related to the copending U.S. patent application Ser. No. TWO-CYCLE ENGINE 09/697,012 now abandoned filed concurrently herewith and incorporated herein by reference.

TECHNICAL FIELD

This invention concerns 2-cycle engines that are fitted to brush cutters, backpack power sprayers, etc., and in particular concerns 2-cycle engines which realize a reduction in total hydrocarbons (THC).

BACKGROUND OF THE INVENTION

With 2-cycle engines fitted to brush cutters or backpack power sprayers, etc., an air-fuel mixture in the crankcase is introduced into the combustion chamber through transfer ports when there is scavenging, and while the combustion chamber is scavenged the combustion chamber is filled.

With conventional 2-cycle engines, air-fuel mixture introduced into the combustion chamber through transfer ports is not left in the combustion chamber, but rather, the mixture is purged out through the outlet port and released into the atmosphere as un-burnt gas, making it a cause of air pollution.

SUMMARY OF THE INVENTION

The purpose of this invention is to provide the 2-cycle engine that can effectively reduce the amount of air-fuel mixture purged out through the outlet port.

DETAILED DESCRIPTION

Figure 1:
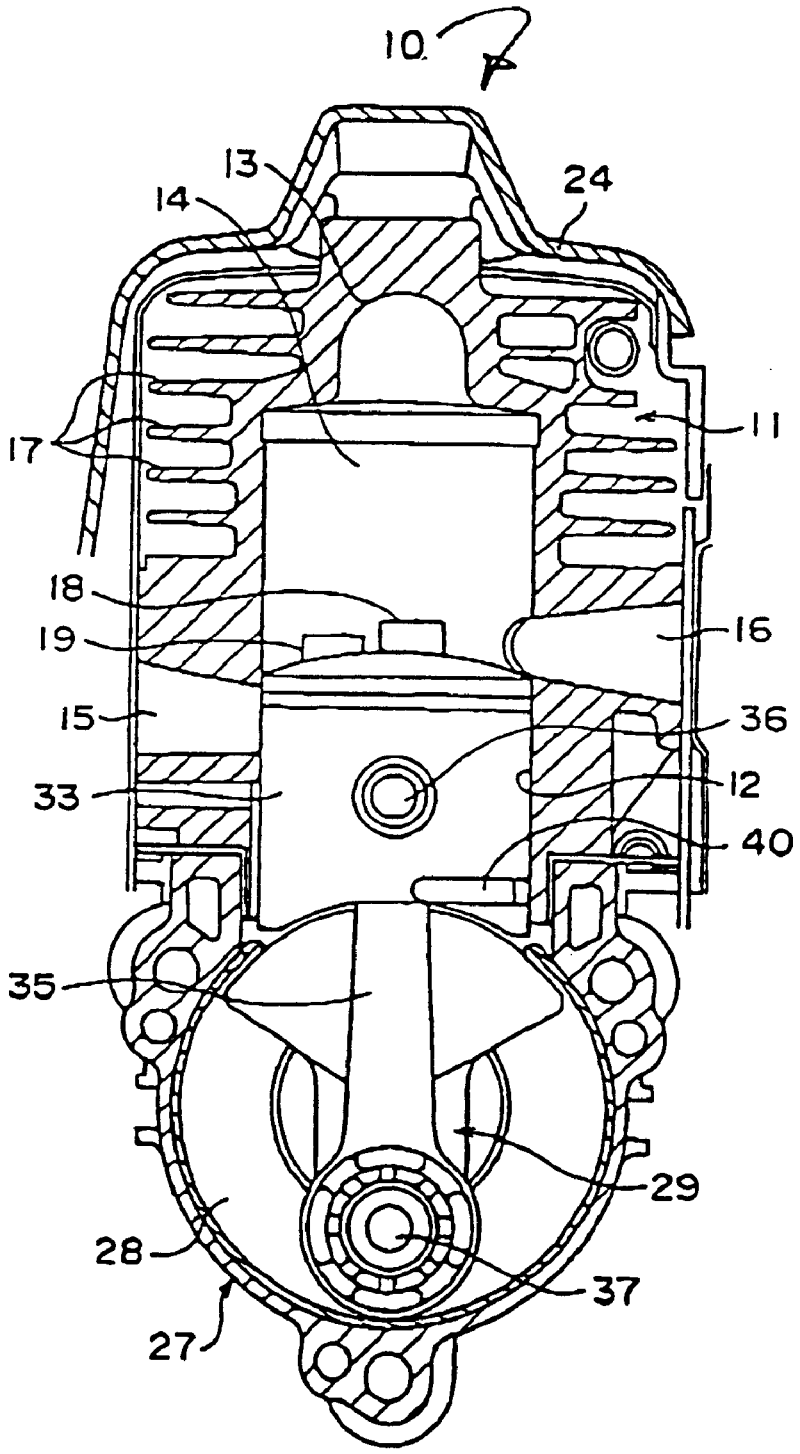
FIG. 1 is a vertical section drawing of Schnuerle type 2-cycle engine.

In reference to FIG. 1, with the 2-cycle engine 10 of this invention, No. 1 transfer ports 18 are in advance of No. 2 transfer ports 19 in scavenging, opening to combustion chamber 14 before the gas that incorporates fuel is introduced to the combustion chamber 14 from No. 2 transfer ports 19 (hereafter this gas is called "gas A") and a gas that has a lower concentration of fuel than gas A (hereafter this gas is called "gas B") is introduced to the combustion chamber 14, and the combustion chamber 14 is scavenged.

The gas fuel mass concentration G is defined with fuel mass G1 and the mass of the gas that includes fuel G2, as G=G1/(G1+G2). The 2-cycle engine 10 includes, in particular, the Schnuerle type 2-cycle engine 10. A Schnuerle type 2-cycle engine 10 is a 2-cycle engine that also acts as a collision reverser, and when both gas flows, introduced into the combustion chamber 14 from the pairs of transfer ports positioned symmetrically on the lateral cross-section of the combustion chamber 14, collide with themselves, there is a reverse eddy.

Gas B includes gases with a fuel mass concentration of 0. Gas A is a gas that is introduced to crankcase 28 from a carburetor through inlet port 15 for example during intake action (hereafter this gas is called "gas C") and then is introduced into No. 2 transfer ports 19; however it does not need to be gas C itself—for example in order to reduce hydrocarbons (HC) in the exhaust, it can have exhaust gas mixed in a suitable way with gas C (however the fuel mass concentration must be greater than gas B).

No. 1 transfer ports 18, in advance of gas A introduction to combustion chamber 14 from No. 2 transfer ports 19, fully introduces gas B to the combustion chamber 14, and throughout the whole period of scavenging, it is not necessary for gas B to be introduced to the combustion chamber 14 and to be burned. That is to say, during the cycle of scavenging, purging gas from transfer ports to outlet port 16 purge rate drops—it is fine that, for example in the same way as with No. 2 transfer port 19, gas A is introduced from the No. 1 transfer port 18 to the combustion chamber 14.

A gas supplied from the transfer port at the initial scavenging to the combustion chamber 14 is easily purged. There, at initial scavenging, that is to say, when No. 1 transfer ports 18, in advance of No. 2 transfer ports 19, opens to combustion chamber 14, a gas with a small fuel mass concentration—Gas B—is introduced to the combustion chamber 14 from No. 1 transfer ports 18, and in combustion chamber 14 there is purging that leads to implementation of appropriate scavenging inside the combustion chamber 14, and at the same time there is a reduction in amount of fuel in the gas purged, making it possible to control the HC in exhaust gases.

With the 2-cycle engine 10 of this invention, inlet port 15 and outlet port 16 are located on both sides of the diameter 44 (FIG. 2) of a circular lateral cross-section of the combustion chamber 14, with a pair of each of No. 1 transfer ports 18 and No. 2 transfer ports 19 on both sides of the diameter 44; and the pair of No. 1 transfer ports 18 are positioned more towards the exhaust port 16 side of the lateral cross-section of the combustion chamber 14 than the No. 2 transfer ports 19.

Gas B, first introduced to the combustion chamber 14, is introduced to the combustion chamber 14 from the pair of No. 1 transfer ports 18, and gas that has completely burned inside the combustion chamber 14 is purged through the exhaust port 16. Gas A, introduced to the combustion chamber 14 from the pair of No. 2 transfer ports 19, is later than gas B, and in comparison with gas B it is introduced on the inlet port 15 side of the combustion chamber. Accordingly, the main portion of gas purged is gas B, which has a smaller fuel mass concentration, leading to a reduction in HC in exhaust gas and to improvements in efficiency of fuel burning.

With the 2-cycle engine 10 of this invention, both No. 1 transfer ports 18 and both No. 2 transfer ports 19 are set in a direction so that the gases introduced to the combustion chamber 14 collide with themselves.

The two streams of Gas B, introduced to the combustion chamber 14 from the pair of No. 1 transfer ports 18 collide with each other, and create a back eddy. The two streams of Gas A, introduced to the combustion chamber 14 from the pair of No. 2 transfer ports 19 collide with each other, and create a back eddy. The gas A back eddy, because the gas B flows and gas B back eddy exist on the exhaust side 16, is limited in its flow towards the outlet port 16; that is to say, it is limited in the gas to be purged.

With the 2-cycle engine 10 of this invention, gas B has as a component exhaust gas supplied from exhaust system 16 to No. 1 transfer port 18.

Gas B, a main component of which is exhaust gas, may be exhaust gas itself, or it may be a gas that is an appropriate mixture of exhaust gas and air-fuel mixture from crankcase 28 unit.

With the 2-cycle engine 10 of this invention, as for the supply of gas from exhaust system 16 to No. 1 transfer ports 18, when there is increasing and decreasing capacity of combustion chamber 14 by a reciprocating action in the cylinder 11 within the crank angle range including piston 33 top dead center, both ends move to No. 1 transfer ports 18 and outlet port 16, and supply is through the through passage 40 formed by the piston 33 and/or cylinder 11.

The through passage 40 is a channel when formed on the surface of the piston 33 and/or cylinder 11, and is a hole when formed on the inside of the piston 33 and/or cylinder 11. A detailed description of the through passage 40 is provided in related copending U.S. patent application Ser. No. 09/409,265, filed on Sep. 30, 1999, and incorporated herein by reference.

With intake action, the crankcase 28 drops below outlet port 16 air pressure, according to No. 1 transfer ports 18 air pressure. When intake action ends, piston 33 reaches near top dead center, No. 1 transfer ports 18 and outlet port 16 become in a mutually communicative state through the through passage 40, and due to the pressure difference a fixed amount of exhaust gas in the outlet port 16 is introduced into No. 1 transfer ports 18, and No. 1 transfer ports 18 are filled. With this structure, gas B flow input and output control is carried out with a piston valve, and it is not necessary to have a separate opening/closing valve on the through passage 40, making this structure simpler.

Figure 5:
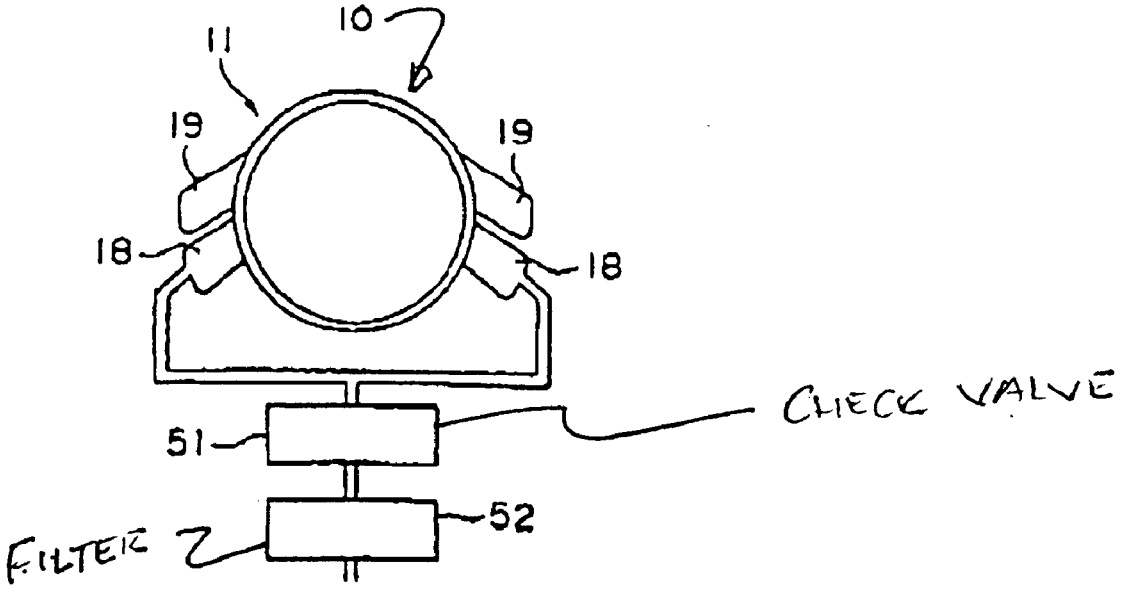
FIG. 5 is an outline composition diagram of a Schnuerle type 2-cycle engine using air instead of exhaust gas as the gas introduced to combustion chamber from No. 1 transfer ports.

Referring to FIG. 5, with the 2-cycle engine 10 of this invention, gas B is air supplied from the outside atmosphere into No. 1 transfer ports 18 through opening/closing valve 51. The opening/closing valve 51 opens and closes in order to control opening and closing timing, for example to synchronize with crank shaft 29, and includes simple check valves that permit the flow, in only one direction, of simple outside air into No. 1 transfer ports 18. Even if opening/closing valve 51 is a simple check valve, the period when No. 1 transfer ports 18 are at a vacuum in terms of air pressure, intake action is limited, and so before scavenging action begins, No. 1 transfer ports 18 can be filled with air.

With the 2-cycle engine 10 of this invention, gas B is an inactive gas supplied from pressurized gas source 56 via control valve 55. A pressurized gas tank 56 can be something like a gas cylinder. Inactive gas would include He, Ne, and hydrogen. Control valve 55 has opening and closing timings set, and supplies inactive gas to No. 1 transfer ports 18. As pressurized inactive gas is supplied from the pressurized gas tank 56 to No. 1 transfer ports 18, due to the action of the control valve 55 the inactive gas can be supplied to No. 1 transfer ports for a short time, at an appropriate time.

What follows is an explanation in the form of working examples of embodiments of this invention, with reference to drawings.

FIG. 1 is a concept drawing of a Schnuerle type 2-cycle engine 10. In FIG. 1, piston 33 is in approximately the bottom dead point. The Schnuerle type 2-cycle engine 10 can be fitted to brush cutters, backpack power sprayers, etc. As for cylinder block 11, a cylindrical space 12 lies within cylinder block 11 along the center axial line of cylinder block 11, and is open to the bottom face of cylinder block 11. A top part indentation 13 is formed in the top surface of cylindrical space 12, and the spark plug discharge (not drawn) is set there. The combustion chamber 14 is formed inside cylindrical space 12 by the area above piston 33 and the top part indentation 13. As for the inlet port 15 and the outlet port 16, they are laid out 180° around the circumference of cylindrical space 12, and cylinder block 11 walls are formed so that the outlet port 16 is slightly higher than the inlet port 15 in the height direction of cylindrical space 12 as shown, and there is communication between the outside of cylinder block 11 and the inside of cylindrical space 12. An engine coolant filter 17 is on the outside upper half of the cylinder block 11, is laid out in the expulsion direction of cylinder block 11, and exposed in the parallel outward direction. No. 1 transfer ports 18 and No. 2 transfer ports 19 are formed so that, when piston 33 nears bottom dead center point, they are in a position open to the combustion chamber 14. A cover 24 is introduced from the top of the cylinder block 11 and the outside of the coolant filter 17. The top of crankcase 27 is connected to the bottom of the cylinder block 11, and internally fixed to crankcase 28. Crankcase 28 is usually communicating with No. 1 transfer ports 18 and No. 2 transfer ports 19, and at the same time, when piston 33 nears the top dead center point, it communicates with the inlet port 15. Crankshaft 29 pivots cylindrical walls of crankcase 27, piston 33 is fitted, freely moving, into cylindrical space 12, and by the reciprocating action it increases and decreases the capacity of the combustion chamber 14. Control rod 35 connects, with free turning, at the small end to the piston 33 with a piston pin 36, and at the large end connects, with free turning, to the crank shaft 29 with a crank pin 37.

Channel 40 is formed on the lower end of the curved surface of piston 33, and extends in the circumferential direction from outlet port 16 to No. 1 transfer ports 18. Within crank angle range, including the piston's top dead center position, the channel 40 communicates with the exhaust port 16 and No. 1 transfer ports 18, mutually connecting exhaust port 16 and No. 1 transfer ports 18.

Figure 2:
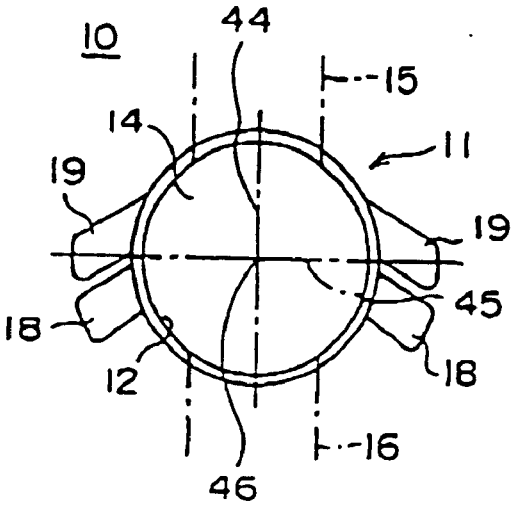
FIG. 2 is a lateral section drawing of a cylinder block at the height of No. 1 transfer ports and No. 2 transfer ports.

FIG. 2 is a lateral section drawing of cylinder block 11 at the height of No. 1 transfer ports 18 and No. 2 transfer ports 19. In the lateral section of cylinder block 11, the inlet port 15 and the outlet port 16 are positioned on the same diameter of the circular lateral section of cylinder space 12, on opposite sides of center 46 of the lateral section of cylinder space 12, and are open to cylinder space 12. No. 1 line 44 is defined as a straight line connecting the centers of the openings of the inlet port 15 and the outlet port 16 on the lateral section of cylinder block 11. No. 2 line 45 is defined as a straight line that passes through the center 46 and is at right angles to line 44. No. 1 transfer ports 18 and No. 2 transfer ports 19 are positioned so one of each is on each side, with one to the exhaust port 16 side of No. 2 line 45 and one to the inlet port 15 side. Also, No. 1 transfer ports 18 and No. 2 transfer ports 19 are symmetrically opposite the other of the same type across No. 1 line 44, and at the same time No. 1 transfer ports 18 and No. 2 transfer ports 19 are angled in the direction of the inlet port 15.

Figure 3:
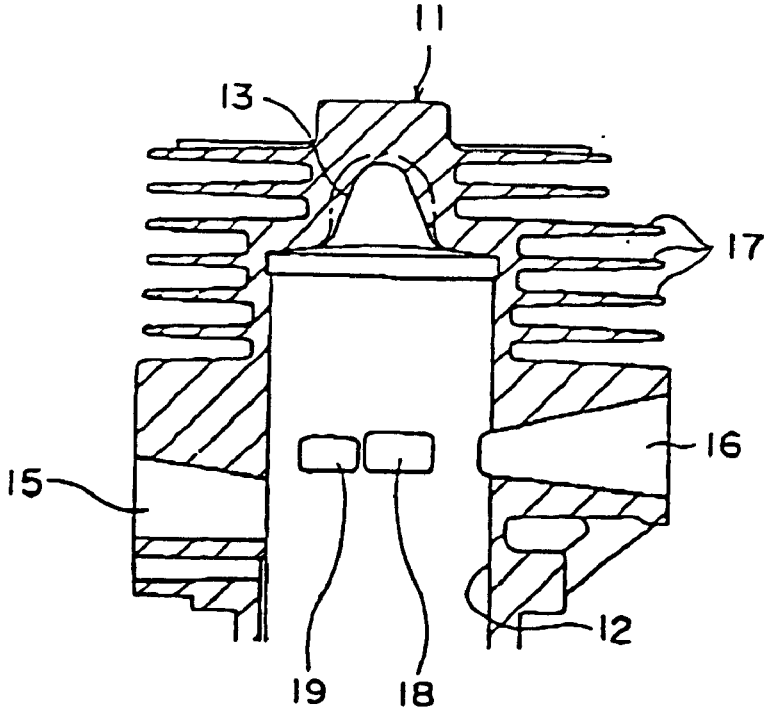
FIG. 3 is a section of a cylinder block, cut at the plane passing through the first line in FIG. 2, with the piston omitted.
Figure 4:
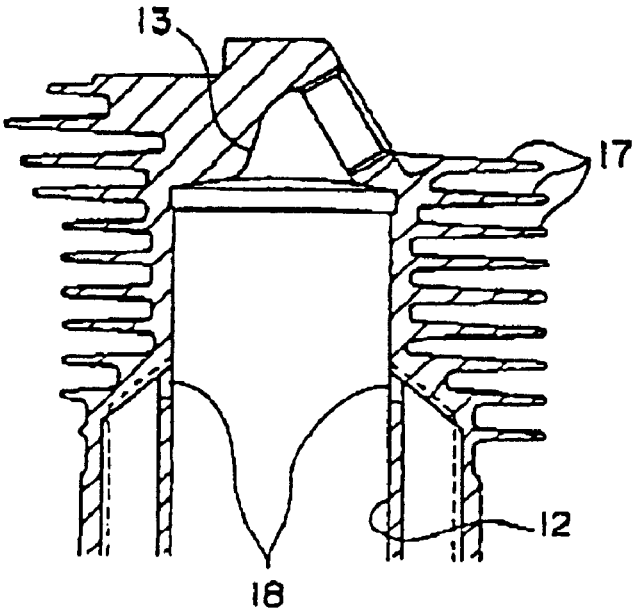
FIG. 4 is a section of a cylinder block, cut at the plane passing through both No. 1 transfer ports, with the piston omitted.

FIG. 3 is a section of cylinder block 11, cut at the plane passing through No. 1 line 44 in FIG. 2, and with piston 33 omitted. FIG. 4 is a section of a cylinder block 11, cut at the plane passing through both of the No. 1 transfer ports 18, with the piston 33 omitted. The No. 1 transfer ports 18 and No. 2 transfer ports 19 both have openings long in the lateral direction, and the vertical dimension of No. 1 transfer ports 18 is greater than that of No. 2 transfer ports 19. As a result, the opening area of No. 1 transfer ports 18 is greater than the opening area of No. 2 transfer ports 19. The height of the bottom of No. 1 transfer ports 18 and No. 2 transfer ports 19 are about equal, and they are approximately the same as the lower edge of the exhaust port 16. As for the heights of the upper edge of No. 1 transfer ports 18 and No. 2 transfer ports 19, the height of the upper edge of No. 1 transfer ports 18 is higher than that of No. 2 transfer ports 19, and the height of No. 1 transfer ports 18 is lower than the height of the upper edge of outlet port 16. Also, No. 1 transfer ports 18 and No. 2 transfer ports 19 are similar, but as can be seen in FIG. 4, against a center line dropped through the cylinder space 12, they are tilted at an angle towards the top part of cylinder space 12, and gas flow from No. 1 transfer ports 18 and No. 2 transfer ports 19 into combustion chamber 14 is in the direction of the top of cylinder space 12 in the perpendicular section of cylinder space 12.

The following is an explanation of the phases of the Schnuerle type 2-cycle engine 10 operations, with crankshaft 29 turn angle, that is to say, calculation of crank angle.

Piston 33, in the action moving from its bottom dead center position to top dead center position, decreases the capacity of combustion chamber 14, and increases capacity of crankcase 28. When crank angle becomes C1, the exhaust port 16 is closed by piston 33, and air-fuel mixture (air and fuel mixture) are tightly sealed in the combustion chamber 14, and compressed. Further, when crank angle becomes C2 (C2>C1), inlet port 15 passes through to crankcase 28, and in parallel with compression of air-fuel mixture in combustion chamber 14, air-fuel mixture from carburetor is introduced to crankcase 28 through inlet port 15.

When piston 33 comes near top dead center, there is a spark plug discharge, and the fuel in the air-fuel mixture in combustion chamber 14 is ignited, explodes, and piston 33 is driven downward. On the other hand, when piston 33 is near top dead center, the lower edge of piston 33 reaches the height of the exhaust port 16 and No. 1 transfer ports 18, and channel 40 mutually connects exhaust port 16 and No. 1 transfer ports 18. No. 1 transfer ports 18, at this time, are in the same pressure state as crankcase 28 during intake action, and as it is a low pressure, exhaust gas in the exhaust port 16 is introduced into transfer ports 18 through channel 40, and fills transfer ports 18 with a fixed amount of the exhaust gas.

Piston 33 shifts from upper dead center to lower dead center, and when crank angle becomes C3 (C3>C2), the outlet port 16 opens to combustion chamber 14, and burnt gas, as exhaust gas, moves out from outlet port 16 to the muffler (not drawn). Further, when crank angle becomes C4 (C4>C3), the opening of No. 1 transfer ports 18 is opened to combustion chamber 14. Along with this, exhaust gas that filled No. 1 transfer ports 18 is introduced into combustion chamber 14. Exhaust gas from No. 1 transfer ports 18 to combustion chamber 14 slightly faces inlet port 15 in the lateral section of cylinder space 12, and it flows into combustion chamber 14, meeting each other and colliding at line 44, creating a reverse eddy, this time in the direction of the exhaust port 16, scavenging combustion chamber 14, and emitting burnt gas inside combustion chamber 14 out from exhaust port 16. Most of the exhaust gas in combustion chamber 14 from both No. 1 transfer ports 18 are emitted from the outlet port 16 together with burnt gases, as purged gas.

When crank angle become C5 (C5>C4), the opening of No. 2 transfer ports 19 is opened to combustion chamber 14, and now air-fuel mixture in crankcase 28 is introduced to combustion chamber 14 from No. 2 transfer ports 19, slightly in the direction of the inlet port 15 in the lateral section of cylinder space 12; they meet at approximately line 44, colliding and creating a reverse eddy. Because the exhaust gas flows from No. 1 transfer ports 18 and their mutual collision eddy exist on the exhaust port 16 side, this air-fuel mixture reverse eddy is restricted in its movement toward exhaust port 16, limiting its purging from the exhaust port 16, and keeping it in combustion chamber 14.

In this way, the combustion chamber 14 is scavenged, and purged gases, by making them the exhaust gases from No. 1 transfer ports 18 first opened to combustion chamber 14 which are gases with small fuel mass concentration, and a reduction in HC in exhaust is possible. Also, a flow of exhaust gases from the pair of No. 1 transfer ports 18 and a flow collision are created on the exhaust port 16 side in comparison with air-fuel mixture from the pair of No. 2 transfer ports 19, preventing the purging of air-fuel mixture—that is gas having greater fuel mass concentration from the pair of No. 2 transfer ports 19. This also reduced HC in exhaust gas.

FIG. 5 is an outline composition diagram of the Schnuerle type 2-cycle engine 10 using air instead of exhaust gas as the gas introduced to combustion chamber 14 from No. 1 transfer ports 18. A check valve 51 permits flow of gas in one direction only, from air outside cylinder block 11 to No. 1 transfer ports 18 upper part, and prevents gas flow in the reverse direction. In the Schnuerle type 2-cycle engine 10 intake action, there is a vacuum created in crankcase 28, and during the period of the vacuum air from the outside atmosphere flows into No. 1 transfer ports 18 through filter 52 and check valve 51. The amount of this airflow into No. 1 transfer ports 18 is such that it does not cause any difficulty for air-fuel mixture flow into crankcase 28 from inlet port 15 when crankcase 28 is near normal pressure. As a result, at next scavenging action, air in No. 1 transfer ports 18 are introduced to combustion chamber 14 from No. 1 transfer ports 18, scavenging in combustion chamber 14, and becoming purged gas. With this, it is possible to prevent the fuel portion introduced to combustion chamber 14 from No. 2 transfer ports 19 being included in purged gas passed on through the exhaust system in its un-burnt state.

Figure 6:
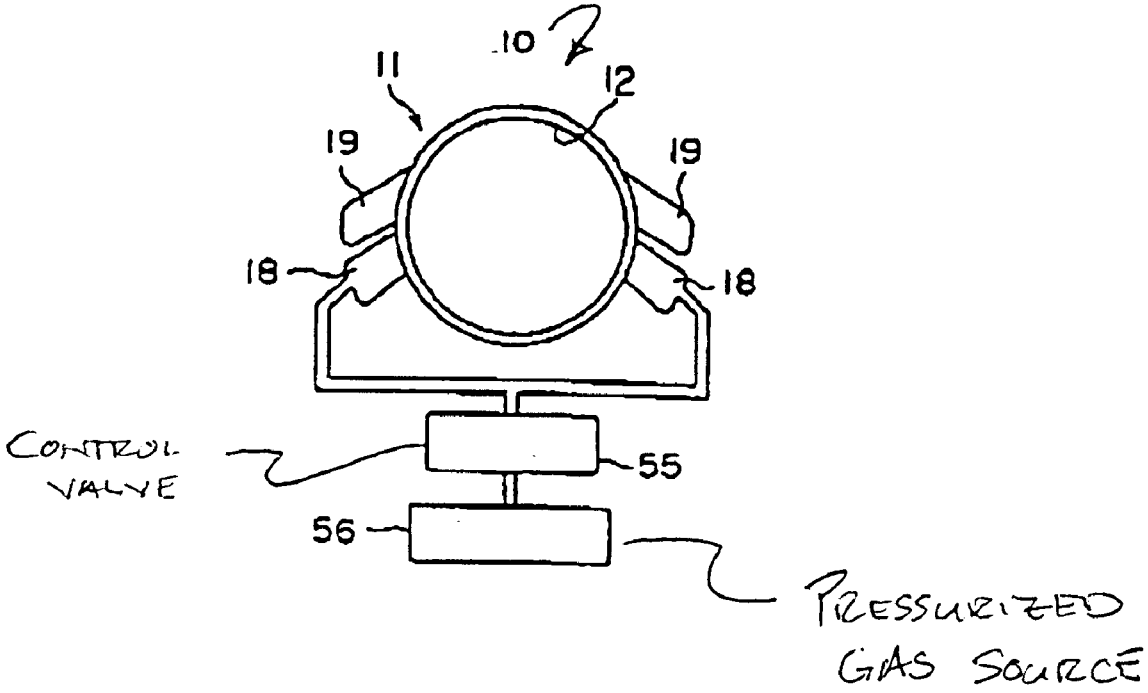
FIG. 6 is an outline composition diagram of a Schnuerle type 2-cycle engine using inactive gas as the gas introduced to combustion chamber from No. 1 transfer ports.

FIG. 6 is an outline composition diagram of the Schnuerle type 2-cycle engine 10 using inactive gas as the gas introduced to combustion chamber 14 from No. 1 transfer ports 18. Gas container 56 is filled with a pressured inactive gas such as He, Ar, Ne, etc. and is connected to the upper part of No. 1 transfer ports 18 through control valve 55. Control valve 55 opens and closes in synchronicity with crankshaft 29, and during final part of intake action of the Schnuerle type 2-cycle engine 10 it is in the open position, inactive gas from gas container 56 is introduced into No. 1 transfer ports 18, filling No. 1 transfer ports 18 with a fixed amount. As a result, during next scavenging action, inactive gas in No. 1 transfer ports 18 is introduced into combustion chamber 14 from No. 1 transfer ports, scavenging combustion chamber 14, and becoming purged gas. This prevents fuel portions introduced to combustion chamber 14 from No. 2 transfer ports 19 from being included in purged gas, and so prevents emissions through the exhaust system in its un-burnt state.

In FIG. 6, gas container 56, filled with inactive gas, is used, but instead of gas container 56 it is possible to use an air tank filled with pressurized air. Pressurized air is created with a prescribed pump, and replenished with a suitable air tank, and so replacement of gas container 56 and fitting refills to gas container 56 has been omitted.

Although specific embodiments of, and examples for, the present invention are described for illustrative purposes, various equivalent modifications can be made without departing from the spirit or scope of the present invention, as will be recognized by those of skill in the relevant art. For example, the teachings provided for lowering hydrocarbons in exhaust gases can be applied not only to the exemplary two-cycle engine system described above, but to other internal combustion engines where reduction of hydrocarbons in exhaust gases would be desirable.

These and other changes can be made to the invention in light of the above detailed description. Therefore, the terms used in the following claims should not be construed to limit the invention to the specific embodiments disclosed, but in general should be construed to include all engines that operate in accordance with the claims to reduce hydrocarbons in the exhaust gases. Accordingly, the invention is not limited by this disclosure, but instead its scope is to be determined entirely by the following claims.

We claim:

1. A two-cycle engine comprising:

a crankcase having a crank chamber;

a fuel intake port in communication with the crankcase, the fuel intake port being configured to provide a fuel mixture having a first fuel mass concentration to the crankcase;

a cylinder having a combustion chamber with an upper end portion, the cylinder being coupled to the crankcase;

an exhaust port in the cylinder;

a first transfer port in communication with the crankcase and the cylinder, the first transfer port having a first opening into the cylinder, the first opening having a first upper edge;

a second transfer port in communication with the crankcase and the cylinder, the second transfer port having a second opening into the cylinder, the second opening having a second upper edge, the second upper edge of the second opening being further away from the upper end portion of the combustion chamber than the first upper edge of the first opening;

a piston reciprocally moveable in the cylinder and positionable to open or close the first and second openings and the exhaust port as the piston reciprocates in the cylinder; and a passage in communication with the first transfer port, the passage being configured to introduce a selected gas having a second fuel mass concentration into the first transfer port.

2. The two-cycle engine of claim 1 wherein the second fuel mass concentration of the selected gas is smaller than the first fuel mass concentration of the fuel mixture.

3. The two-cycle engine of claim 1 wherein the first opening of the first transfer port is closer to the exhaust port than the second opening of the second transfer port.

4. The two-cycle engine of claim 1 wherein the first opening of the first transfer port is larger than the second opening of the second transfer port.

5. The two-cycle engine of claim 1 wherein the first opening of the first transfer port defines a first length dimension and the second opening of the second transfer port defines a second length dimension, and wherein the first length dimension is greater than the second length dimension.

6. The two-cycle engine of claim 1 wherein the first opening of the first transfer port has a first bottom edge and the second opening of the second transfer port has a second bottom edge, and wherein the first bottom edge is at least approximately the same distance from the upper end portion of the combustion chamber as the second bottom edge.

7. The two-cycle engine of claim 1 further comprising:

a third transfer port in communication with the crankcase and the cylinder, the third transfer port having a third opening into the cylinder, the third opening having a third upper edge at least approximately the same distance from the upper end portion of the combustion chamber as the first upper edge of the first opening; and a fourth transfer port in communication with the crankcase and the cylinder, the fourth transfer port having a fourth opening into the cylinder, the fourth opening having a fourth upper edge at least approximately the same distance from the upper end portion of the combustion chamber as the second upper edge of the second opening.

8. The two-cycle engine of claim 7 wherein the third opening of the third transfer port is closer to the exhaust port than the second opening of the second transfer port and the fourth opening of the fourth transfer port.

9. The two-cycle engine of claim 7 wherein:

the first and third transfer ports are angled so that a first gas introduced into the cylinder through the first transfer port opening collides with a third gas introduced into the cylinder through the third transfer port opening; and the second and fourth transfer ports are angled so that a second gas introduced into the cylinder through the second transfer port opening collides with a fourth gas introduced into the cylinder through the fourth transfer port opening.

10. The two-cycle engine of claim 9 wherein:

the first and third transfer ports are angled to provide a first back eddy; and the second and fourth transfer ports are angled to provide a second back eddy, the first back eddy being closer to the exhaust port than the second back eddy.

11. The two-cycle engine of claim 1 wherein the cylinder has an inner wall and the piston has an outer surface, and wherein the passage comprises a groove with an open cross-section formed in the piston's outer surface and open along its length toward the inner wall of the cylinder.

12. The two-cycle engine of claim 11 wherein the groove has a U-shaped open cross-section.

13. The two-cycle engine of claim 11 wherein the groove extends at least generally circumferentially from the exhaust port to the first transfer port when the piston is in a pre-selected stroke position.

14. The two-cycle engine of claim 11 wherein the groove is configured for communication between the exhaust port and the first transfer port when the piston is in a top dead center piston position.

15. The two-cycle engine of claim 11 wherein the open cross-section of the groove is closed off along its entire length by the inner wall of the cylinder when the piston is in a position intermediate of a top dead center and bottom dead center position.

16. The two-cycle engine of claim 1 further comprising a valve coupled to the passage and moveable to an open position to introduce the selected gas into the first transfer port.

17. The two-cycle engine of claim 16 wherein the selected gas is outside air.

18. The two-cycle engine of claim 16 wherein the two-cycle engine is connectable to a pressurized gas source, and wherein the selected gas is inert gas supplied from the pressurized gas source.

19. A method for reducing hydrocarbons in exhaust gas from a two-cycle engine, the two-cycle engine having a crankcase with a crank chamber, an intake port in communication with the crankcase, a cylinder having a combustion chamber, the cylinder being coupled to the crankcase, an exhaust port in the cylinders a first transfer port in communication with the crankcase and the cylinder, the first transfer port having a first opening into the cylinder, a second transfer port in communication with the crankcase and the cylinder, the second transfer port having a second opening into the cylinder, and a piston reciprocally moveable in the cylinder and positionable to open or close the first and second openings and the exhaust port as the piston reciprocates in the cylinder, the method comprising:

moving the piston away from the combustion chamber along a down-stroke;

introducing a first gas having a first fuel mass concentration into the first transfer port through a passage as the piston moves along the down-stroke;

introducing the first gas into the cylinder through the first opening as the piston moves along the down-stroke, and after introducing the first gas into the cylinder, introducing a second gas having a second fuel mass concentration into the cylinder through the second opening as the piston moves along the down-stroke, the second fuel mass concentration of the second gas being greater than the first fuel mass concentration of the first gas.

20. The method of claim 19 wherein:

introducing the first gas into the cylinder comprises introducing the first gas into the cylinder through the first opening at a first location; and introducing the second gas into the cylinder comprises introducing the second gas into the cylinder through the second opening at a second location further from the exhaust port than the first location.

21. The method of claim 19 wherein the exhaust port in the cylinder is configured to expel an exhaust gas, and wherein introducing the first gas into the cylinder comprises introducing the exhaust gas into the cylinder.

22. The method of claim 19 wherein introducing the first gas into the cylinder comprises introducing outside air into the cylinder.

23. The method of claim 19 wherein the two-cycle engine is connectable to a pressurized inert gas source, and wherein introducing the first gas into the cylinder comprises introducing an inert gas from the pressurized inert gas source into the cylinder.

* * * * *